US005852427A

United States Patent [19]

Buzak

[11] Patent Number: 5,852,427

[45] Date of Patent: Dec. 22, 1998

[54] REDUCING CROSS TALK EFFECTS IN ELECTRO-OPTICAL ADDRESSING STRUCTURES

[75] Inventor: Thomas S. Buzak, Aloha, Oreg.

[73] Assignee: Tektronix, Inc., Wilsonville, Oreg.

[21] Appl. No.: 134,506

[22] Filed: Oct. 8, 1993

Related U.S. Application Data

[63] Continuation of Ser. No. 854,145, Mar. 19, 1992, abandoned.

[51] Int. Cl.[6] ..... G09G 3/36

[52] U.S. Cl. ..... 345/97; 345/208

[58] Field of Search ..... 345/99, 87, 89, 345/94, 97, 95, 96, 100, 208, 209; 359/55, 92; 349/33, 143

[56] References Cited

U.S. PATENT DOCUMENTS

| | | | |
|---|---|---|---|
| 4,117,472 | 9/1978 | Freer | 340/805 |
| 4,322,659 | 3/1982 | De Jule et al. | 315/169.1 |
| 4,352,101 | 9/1982 | De Jule | 340/769 |
| 4,391,492 | 7/1983 | Lu et al. | 350/351 |

FOREIGN PATENT DOCUMENTS

| | | | |
|---|---|---|---|
| 0251230 | 1/1988 | European Pat. Off. | 340/384 |

OTHER PUBLICATIONS

Akatsuka et al "Material Approach for the Reduction of Crosstalk in Simple Matrix 2CDs". 1991, pp. 64–67.

*Primary Examiner*—Regina Liang
*Attorney, Agent, or Firm*—John D. Winkelman; Paul S. Angello

[57] ABSTRACT

A method and an apparatus reduce cross talk effects in electro-optical addressing structures. In a preferred embodiment, a flat panel liquid crystal display system (10) includes a layer (28) of frequency-sensitive liquid crystal material having a dielectric anisotropy that approaches zero for signal frequencies greater than a characteristic threshold frequency $f_{th}$. The frequency-sensitive liquid crystal material is nonresponsive to components of signals with frequencies greater than the threshold frequency $f_{th}$. A data driver (32) delivers inverted data signals (62) and conventional, noninverted data signals (64) to each of the multiple display elements (16) during successive first and second time intervals, respectively. As a result, the data driver generates cross talk having frequency components greater than the characteristic threshold frequency $f_{th}$ of the liquid crystal material. The liquid crystal material is not responsive to the high frequency cross talk, thereby substantially eliminating the cross talk effects.

13 Claims, 6 Drawing Sheets

REDUCING CROSS TALK EFFECTS IN ELECTRO-OPTICAL ADDRESSING STRUCTURES

This is a continuation of application Ser. No. 07/854,145, filed Mar. 19, 1992, and now abandoned.

TECHNICAL FIELD

The present invention relates to electro-optical addressing structures having multiple address locations arranged in an array and, in particular, to reducing the effects of incidental data propagation or cross talk between the address locations.

BACKGROUND OF THE INVENTION

Electro-optical addressing structures are employed in a variety of applications including video cameras, data storage devices, and flat panel liquid crystal displays. Such addressing structures typically include very large numbers of address locations arranged in an array. For example, a flat panel liquid crystal display configured in accordance with a high-definition television format would typically include at least 2 million address locations. The address locations would correspond to display elements or pixels that are arranged as about 1000 lines with about 2000 pixels each.

Adjacent pixels in such a display are spaced-apart by a distance of about 0.5 mm and have incidental capacitive couplings as a consequence of these small spacings. This coupling will be referred to as side-to-side coupling. In addition, the operation of electro-optical addressing structures typically includes carrying the data signals for all the pixels in a row or column on a common conductor adjacent the pixels. The electrical properties of the electro-optical addressing structures result in capacitive coupling between all the pixels in the column or row. This coupling will be referred to as front-to-back coupling. These two types of capacitive coupling cause the data signal directed to a particular pixel to be carried to other pixels as incidental data signals or cross talk.

The cross talk is image-dependent and contaminates the data signals actually directed to a specific pixel. Cross talk effects include an unpredictable gray scale that limits the number of achievable gray levels below the number necessary for acceptable video performance. It will be appreciated that gray scale in this context refers the range of available light output levels in either monochrome or color display systems.

One type of electro-optical addressing structure used in flat panel liquid crystal displays employs an array of thin film transistors to address pixel locations. A method of reducing the image dependent cross talk in such displays is described by Howard et al. in "Eliminating Crosstalk in Thin Film Transistor/Liquid Crystal Displays" *International Display Research Conference*, 230–35, 1988. The method described by Howard et al. includes successively applying a data input signal and its complement to a row of address locations during a row addressing period.

In conventional addressing, a data signal $V_i$ is applied to a row of pixels for a row address period. The method of Howard et al. entails applying the data signal $V_i$ to the row of pixels for one-half the row address period, and then applying a data signal complement $\overline{V}_i$ for the remaining one-half of the row address period. The data signal complement $\overline{V}_i$ is formed as the difference between a fixed level $V_m$ and the original data signal $V_i$.

The method of Howard et al. does not adequately reduce all types of cross talk effects in all addressing structures, particularly those having a relatively high susceptibility to cross talk errors produced by side-to-side coupling. One such addressing structure is described in U.S. Pat. No. 4,896,149 of Buzak et al. for "Addressing Structure Using Ionizable Gaseous Medium". The relatively high susceptibility to cross talk errors produced by side-to-side coupling is believed to be a consequence of a physical configuration that positions address locations or pixels relatively far from an electrically grounded surface. The relatively large distance to the grounded surface allows the formation of incidental electric fields (i.e., cross talk) between nearby pixels.

SUMMARY OF THE INVENTION

An object of the present invention is, therefore, to provide a method and an apparatus for reducing cross talk effects in electro-optical addressing structures.

Another object of this invention is to provide such a method and an apparatus that are effective with a variety of electro-optical addressing structures.

A further object of this invention is to provide such a method and an apparatus that are effective with addressing structures that have a relatively high susceptibility to cross talk.

The present invention is a method and an apparatus for reducing cross talk effects in electro-optical addressing structures employed in, for example, flat panel display systems. Such a system typically includes an addressing structure for addressing and delivering data signals to each of multiple address locations arranged in an array, each address location corresponding to a display element or pixel. Groups of pixels have incidental capacitive couplings that carry noise in the form of incidental data signals or cross talk. To address the pixels, the addressing structure may employ any of a variety of addressing structure elements including thin film transistors, diodes, or an ionizable gaseous medium.

A display system of the present invention includes a frequency-sensitive liquid crystal material having a dielectric anisotropy that approaches substantially zero for signal frequencies greater than a characteristic threshold frequency. As a result, the frequency-sensitive liquid crystal material is nonresponsive to signal components having frequencies greater than the threshold frequency. Cross talk effects in the display system are reduced by operating it so that the cross talk signal is generated with components at frequencies greater than the threshold frequency of the liquid crystal material.

In a preferred embodiment, the display system includes a data driver that delivers inverted data signals and the conventional, noninverted data signals to each of the pixels during successive first and second time intervals, respectively. The cross talk generated by the data driver has essentially all its components at frequencies greater than the characteristic threshold frequency of the liquid crystal material. The liquid crystal material is not responsive to or affected by such high frequency components of cross talk, thereby substantially eliminating the effects of cross talk. The cross talk effects are substantially eliminated for all displays, including the liquid crystal flat panel display system of the type described by Buzak et al. in U.S. Pat. No. 4,896,149.

Additional objects and advantages of the present invention will be apparent from the detailed description of the preferred embodiment thereof, which proceeds with reference to the accompanying drawings.

DETAILED DESCRIPTION OF PREFERRED EMBODIMENT

Figure 1:
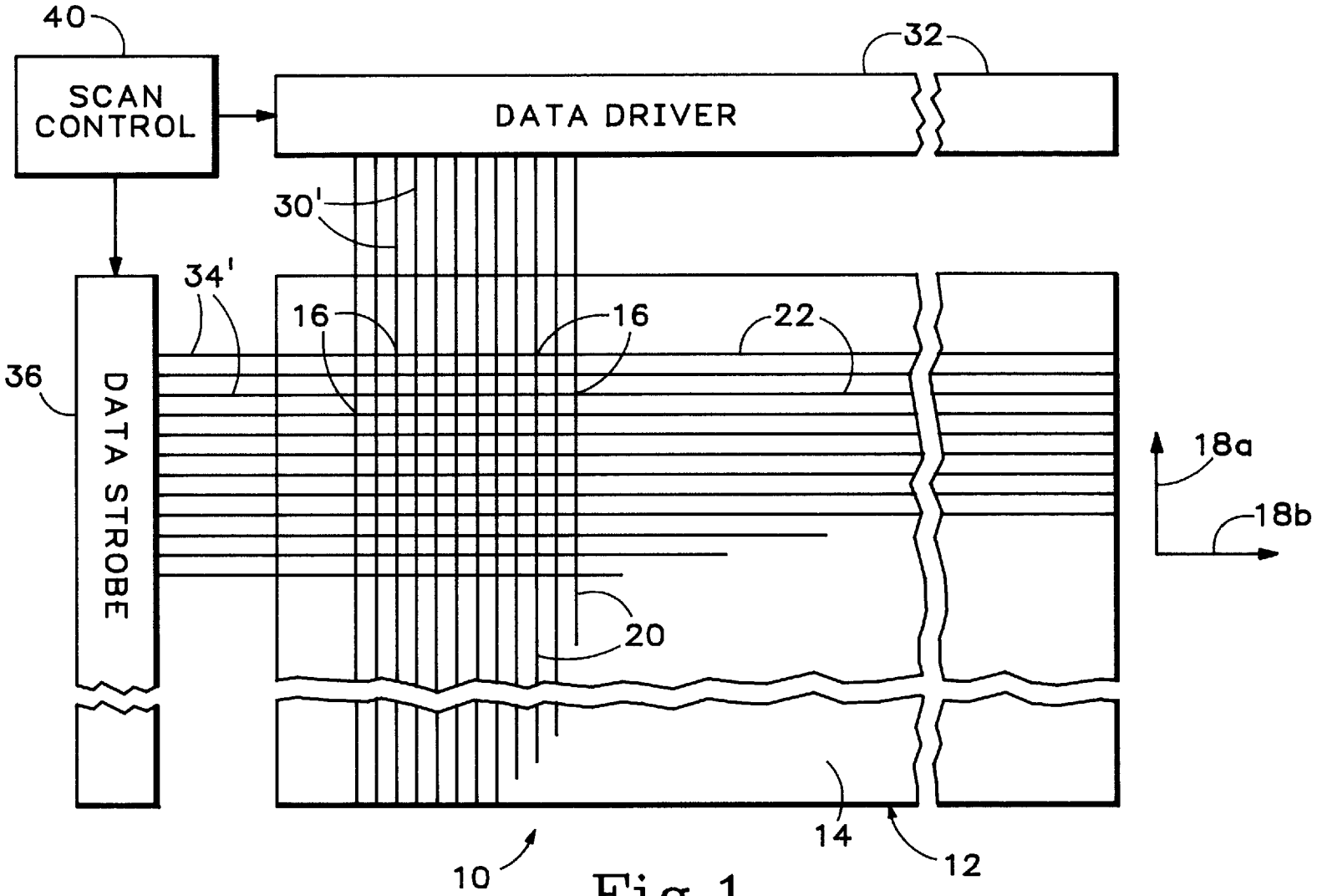
FIG. 1 is a front view of a display panel and associated drive circuitry of a display system incorporating the apparatus of the present invention.

FIG. 1 shows a flat panel display system 10 having a display panel 12 with a display surface 14. A rectangular planar array of nominally identical data storage or display elements 16 are mutually spaced apart by predetermined distances in vertical and horizontal directions 18*a* and 18*b*, respectively. To address display elements 16, display panel 12 may employ any of a variety of addressing structure elements including thin film transistors, diodes, or an ionizable gaseous medium, the latter of which is preferred and described below.

Each display element 16 in the array represents the overlapping portions of thin, narrow electrodes 20 arranged in vertical columns and elongate, narrow channels 22 arranged in horizontal rows. (The electrodes 20 are hereinafter referred to as "column electrodes 20.") The display elements 16 in each of the rows of channels 22 represent one line of data.

Figure 2:
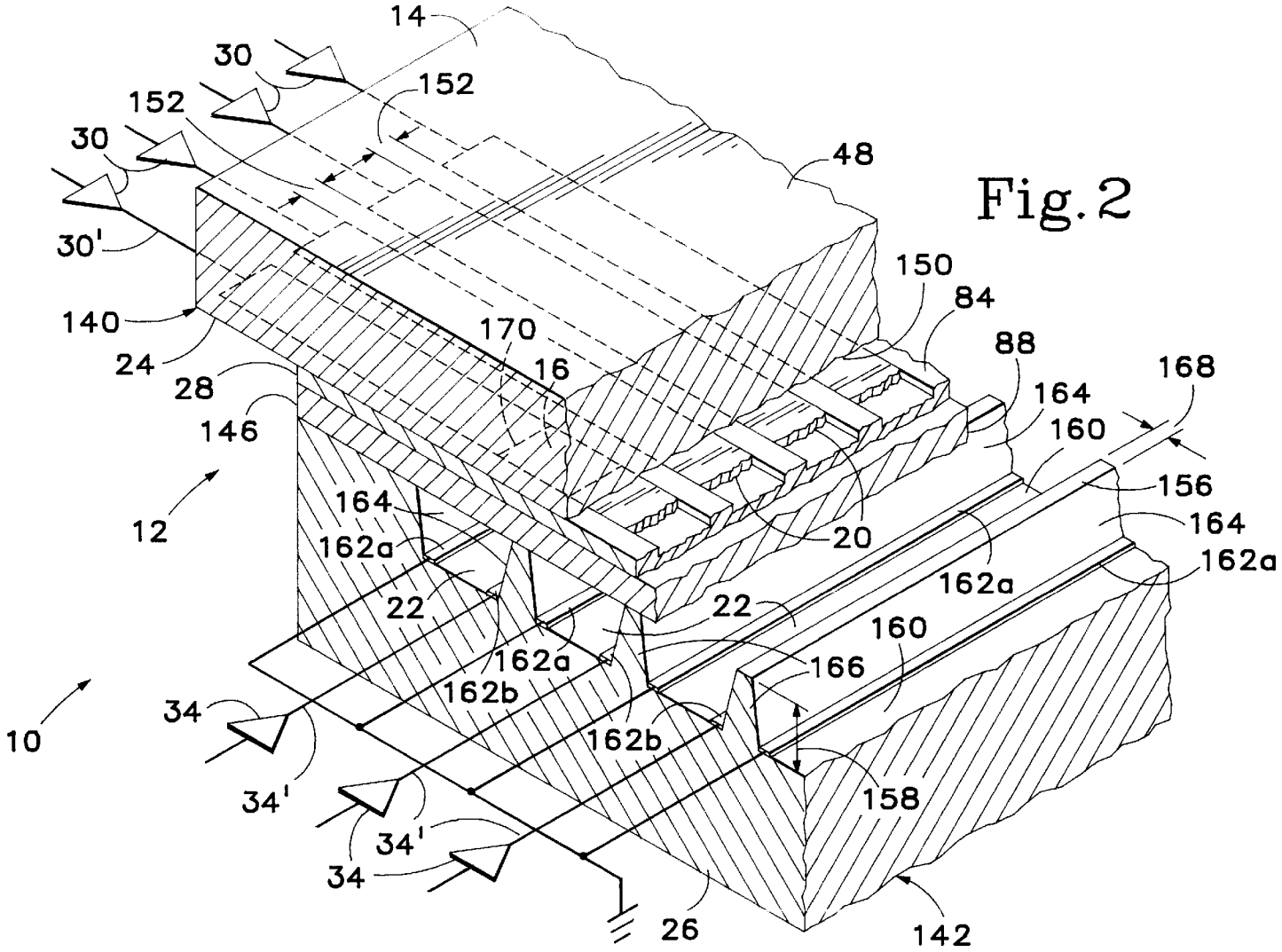
FIG. 2 is an enlarged fragmentary oblique projection showing the layers of structural components forming the display panel of FIG. 1.

With reference to FIGS. 1 and 2, the widths of column electrodes 20 and channels 22 determine the dimensions of display elements 16, which are of rectangular shape. Column electrodes 20 are deposited on a major surface of a first electrically nonconductive, optically transparent substrate 24, and channels 22 are inscribed in a major surface of a second electrically nonconductive, optically transparent substrate 26. A layer 28 of frequency-sensitive electro-optic material, such as two-frequency nematic liquid crystal No. ZLI-2461, manufactured by E. Merck, Darmstadt, Frankfurt, Germany, is captured between substrates 24 and 26. Skilled persons will appreciate that certain systems, such as a reflective display of either the direct view or projection type, would require that only one of the substrates be optically transparent.

Column electrodes 20 receive data drive signals of the analog voltage type developed on parallel output conductors 30' by different ones of the output amplifiers 30 of a data driver or drive means 32. Channels 22 receive data strobe signals of the voltage pulse type developed on parallel output conductors 34' by different ones of the output amplifiers 34 of a data strobe means or circuit 36. To synthesize an image on substantially the entire area of display surface 14, display system 10 employs a scan control circuit 40 that coordinates the functions of data driver 32 and data strobe 36 so that all columns of display elements 16 of display panel 12 are addressed row-by-row in row scan fashion.

Figure 3:
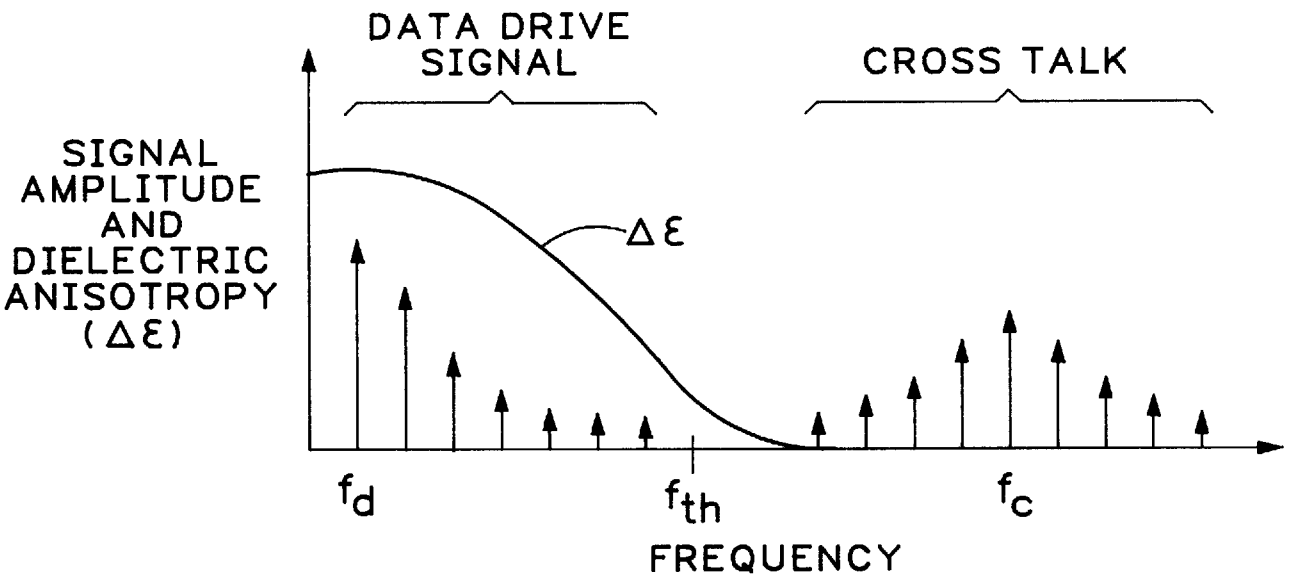
FIG. 3 is a graph showing the dielectric anisotropy of a frequency-sensitive liquid crystal material relative to the frequencies of cross talk generated in accordance with the present invention.

FIG. 3 is a graph 50 showing the dielectric anisotropy $\Delta\epsilon$ of the frequency-sensitive liquid crystal material in layer 28. The dielectric anisotropy is relatively small, preferably approaching zero, for signal frequencies greater than a characteristic threshold frequency $f_{th}$. As a result, the frequency-sensitive liquid crystal material is virtually nonresponsive to signals having frequencies greater than the threshold frequency $f_{th}$.

The frequency sensitive characteristics of the liquid crystal material in layer 28 cooperate with data driver 32 to reduce the image degradation characteristic of cross talk in display system 10. In particular, data driver 32 delivers a data drive signal that includes inverted data signals and conventional, noninverted data signals to each of display elements 16 during successive first and second time intervals, respectively. The first and second time intervals are preferably of substantially equal duration.

With reference to FIG. 3, the data drive signal and the resulting cross talk each have multiple frequency components of different magnitudes, the frequency components and their relative magnitudes being represented graphically. The data drive signal has a primary frequency $f_d$ and component frequencies that are less than the threshold frequency $f_{th}$ of the liquid crystal material. The resulting cross talk signal has a primary frequency $f_c$ and component frequencies that are greater than the threshold frequency $f_{th}$ of the liquid crystal material.

The liquid crystal material is not responsive to, and not affected by, the cross talk because substantially all its frequency components are greater than the threshold frequency of the liquid crystal material. Accordingly, data driver 32 cooperates with the frequency-sensitive liquid crystal material in layer 28 to substantially eliminate cross talk effects such an unpredictable gray scale.

The substantial elimination of cross talk effects in display system 10 relates to whether the effects are discernible by an observer of display panel 12. The liquid crystal material has a small dielectric anisotropy and is nonresponsive to cross talk signals to the extent that cross talk effects are not discernible by an observer.

The primary frequency $f_c$ of the cross talk generated by data driver 32 may be computed as the product of the video field rate and the number of lines in the display. For example, a 1,000 line display would result in a cross talk component of a data drive signal with a primary frequency of about 60 kHz. However, the spectral distribution of the cross talk is image dependent. The threshold frequency $f_{th}$ preferably falls below the lowest frequency component of the cross talk distribution and above the highest frequency component of the data drive signal distribution, as shown in FIG. 3. It will be appreciated, however, that low magnitude frequency components of the cross talk and data drive signal distributions can occur, respectively, below and above the threshold frequency $f_{th}$.

Figure 4A:
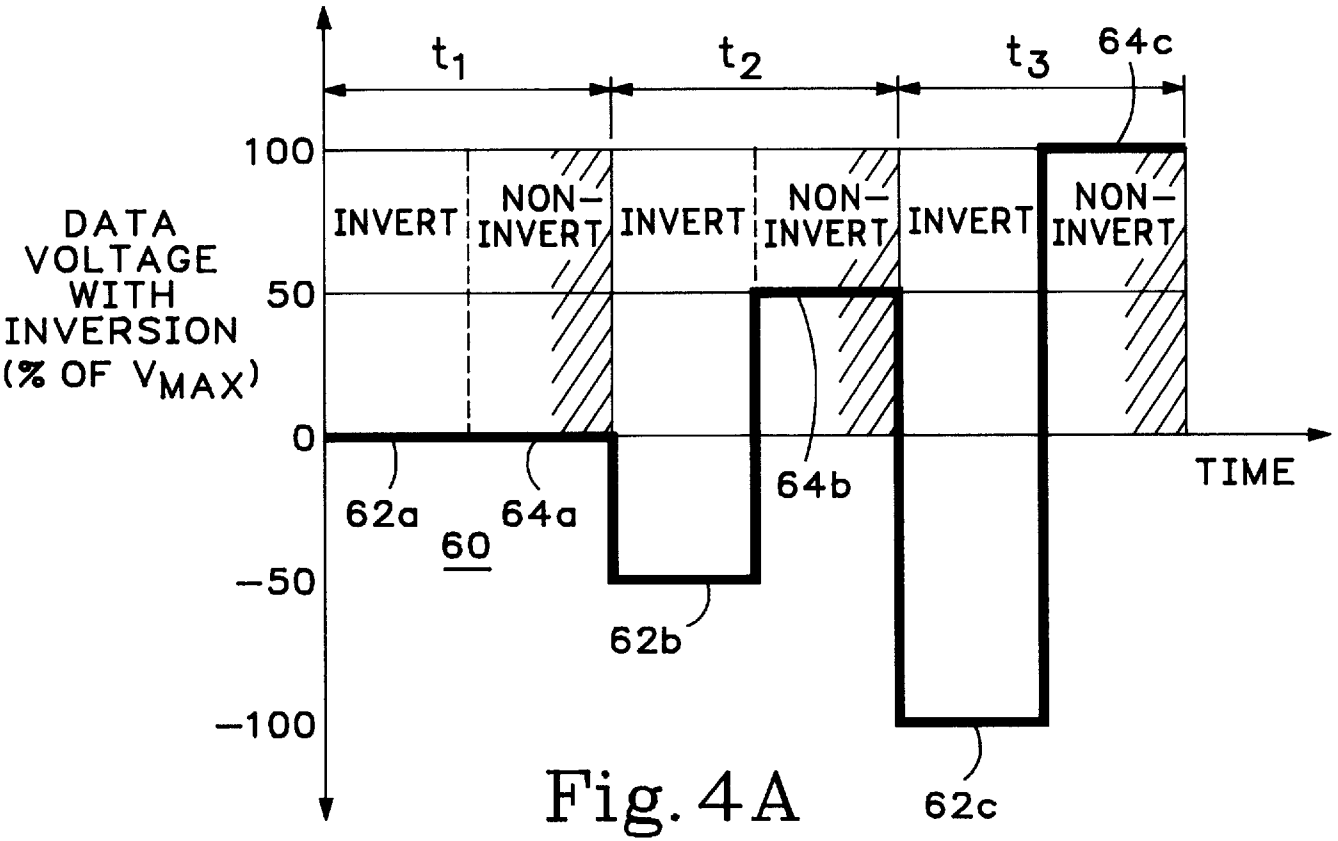
FIG. 4A is a schematic timing diagram showing the application of inverted data signals and noninverted data signals to one column of address locations in the display panel of FIG. 1.

FIG. 4A is a schematic timing diagram 60 showing exemplary inverted data signals 62*a*, 62*b*, and 62*c* and corresponding noninverted data signals 64*a*, 64*b*, and 64*c* applied to three display elements 16 arranged along one column electrode 20 of display panel 12. The data signals are shown as percentages of a maximum data voltage $V_{max}$.

The three display elements are positioned in three separate rows that are addressed during three separate row address periods $t_1$, $t_2$, and $t_3$. The row address periods $t_1$, $t_2$, and $t_3$ represent the times during which the inverted and noninverted data signals are present on column electrodes 20, as described below in greater detail.

With reference to FIG. 2, display panel 12 includes a pair of generally parallel electrode structures 140 and 142 spaced apart by layer 28 of the frequency sensitive nematic liquid crystal material. A thin layer 146 of dielectric material, such as glass, mica, or plastic, is positioned between layer 28 and electrode structure 142. Electrode structure 140 includes glass dielectric substrate 24 that has deposited on its inner surface 150 column electrodes 20 of indium tin oxide, which is optically transparent, to form a striped pattern. Adjacent pairs of column electrodes 20 are spaced apart a distance 152, which defines the horizontal space between next adjacent display elements 16 in a row.

Electrode structure 142 includes glass dielectric substrate 26 into whose inner surface 156 multiple channels 22 of essentially trapezoidal cross section are inscribed. Channels 22 have a depth 158 measured from inner surface 156 to a base portion 160. Each one of the channels 22 has a pair of thin, narrow metal electrodes 162*a* and 162*b* extending along base portion 160, and a pair of inner side walls 164 diverging in the direction away from base portion 160 toward inner surface 156.

Each of electrodes 162*a*, referred to as reference electrodes 162*a*, is connected to a common electrical reference potential, which can be fixed at ground potential as shown. The electrodes 162*b* of the channels 22 are connected to different ones of the output amplifiers 34 (of which three are shown in FIG. 2) of data strobe 36. (The electrodes 162*b* are hereinafter referred to as "row electrodes 162*b*.") To ensure proper operation of the addressing structure, the reference electrodes 162*a* and row electrodes 162*b* preferably are connected to the electrical reference potentials and the outputs 34' of data strobe 36, respectively, on opposite sides of display panel 10.

The sidewalls 164 between adjacent channels 22 define a plurality of support structures 166 with top surfaces 156 that support layer 146 of dielectric material. Adjacent ones of channels 22 are spaced apart by the width 168 of the top portion of each support structure 166, which width 168 defines the vertical space between next adjacent display elements 16 in a column. The overlapping regions 170 of column electrodes 20 and channels 22 define the dimensions of display elements 16, which are shown in dashed lines.

The magnitude of the voltage applied to column electrodes 20 specifies the distance 152 to promote isolation of adjacent column electrodes 20. Distance 152 is typically much less than the width of column electrodes 20. The inclinations of the side walls 164 between adjacent channels 22 specify the distance 168, which is typically much less than the width of channels 22. The widths of the column electrodes 20 and the channels 22 are typically the same and are a function of the desired image resolution, which is specified by the display application. It is desirable to make distances 152 and 168 as small as possible. In current models of display panel 12, the channel depth 158 is one-half the channel width.

Each of channels 22 is filled with an ionizable gas, preferably one that includes helium. Layer 146 of dielectric material functions as an isolating barrier between the ionizable gas contained within channel 22 and layer 28 of liquid crystal material. The absence of dielectric layer 146 would permit either the liquid crystal material to flow into the channel 22 or the ionizable gas to contaminate the liquid crystal material. Dielectric layer 146 may be eliminated from displays that employ a solid or encapsulated electro-optic material.

The ionizable gas contained within each of the channels 22 operates as an electrical switch whose contact position changes between binary switching states as a function of the voltage applied by data strobe 36. The switches are connected between reference electrodes 162*a* and layer 28 of liquid crystal material. The absence of a strobe pulse allows the gas within the channels 22 to be in a nonionized, nonconducting state, thereby causing the ionizable gas to operate as an open switch. A strobe pulse applied to row electrode 162*b* is of a magnitude that causes the gas within the channel 22 to be in an ionized, conducting state, thereby causing the ionizable gas to operate as a closed switch.

More specifically, the ionizable gas contained within channels 22 beneath electrode structure 140 communicates with layer 146 of the dielectric material to provide an electrically conductive path from layer 146 of the dielectric material to reference electrode 162*a*. The plasma in a channel 22 whose row electrode 162*b* receives a strobe pulse provides a ground path to the portion of liquid crystal material positioned adjacent the plasma. This allows the liquid crystal material to sample the analog data voltages applied to column electrodes 20. Extinguishing the plasma acts to remove the conducting path, thereby allowing the data sample to be held across the display element. The voltages remain stored across layer 28 of the liquid crystal material until voltages representing a new line of data in a subsequent image field are developed across the layer 28. The above-described addressing structure and technique provide signals of essentially 100% duty cycle to every one of the display elements 16.

Figure 4B:
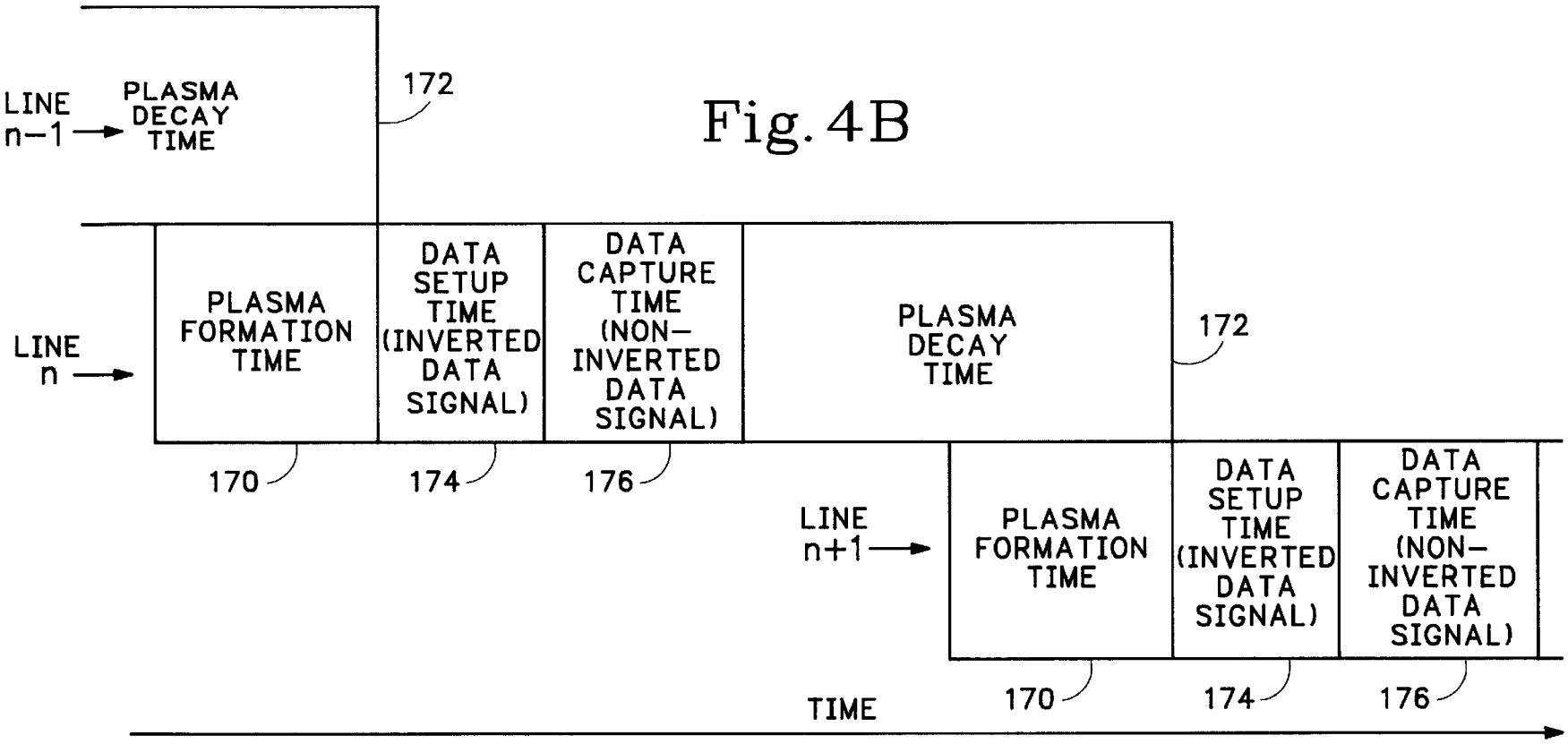
FIG. 4B is a schematic timing diagram showing the time period during which such signals are applied.

FIG. 4B is a schematic timing diagram showing the addressing of three successive rows or lines in display system 10. Similar time segments in the three lines bear the same reference numerals.

An exemplary line "n" of data requires a time 170 for the plasma to form after the row electrode 162*b* of the strobed channel 22 receives a strobe pulse. In the preferred embodiment, the plasma formation time 170 for helium gas is nominally a few microseconds. The plasma formation time 170 begins by initiating the strobe pulse during a plasma decay time 172 for the preceding line n-1. The plasma decay time 172 represents the time during which the plasma in channel 22 returns to a deionized state upon the removal of a strobe pulse from row electrode 162*b*.

A data setup time 174 represents the time during which data driver 32 slews between the data values of two next adjacent lines of data and develops on output amplifiers 30 the analog voltage signals that are applied to column electrodes 20. The data setup time 174 is a function of the electronic circuitry used to implement data driver 32. A data setup time 174 of less than 1.0 microsecond is achievable.

The data capture time 176 depends on the conductivity of the ionizable gas contained within channels 22. A preferred operating point is that which provides the fastest data capture time 176 for positive ion current from the anode (reference electrode 162*a* ) to the cathode (row electrode 162*b*). Such an operating point can be achieved by using helium gas at a pressure of 40 millibars and a current of 7.5 milliamperes to produce a data capture time 176 of about 0.5 microsecond. Optimum values of pressure and current depend on the size and shape of channels 22.

With reference to FIGS. 4A and 4B, the row address periods $t_1$, $t_2$, and $t_3$ represent the times during which the inverted and noninverted data signals are present on column electrodes 20. The cross-hatched area in each row address period represents the corresponding data capture time 176. Accordingly, each of the row address periods $t_1$, $t_2$, and $t_3$ corresponds to the sum of a data setup time 174 and a data capture time 176.

Figure 5:
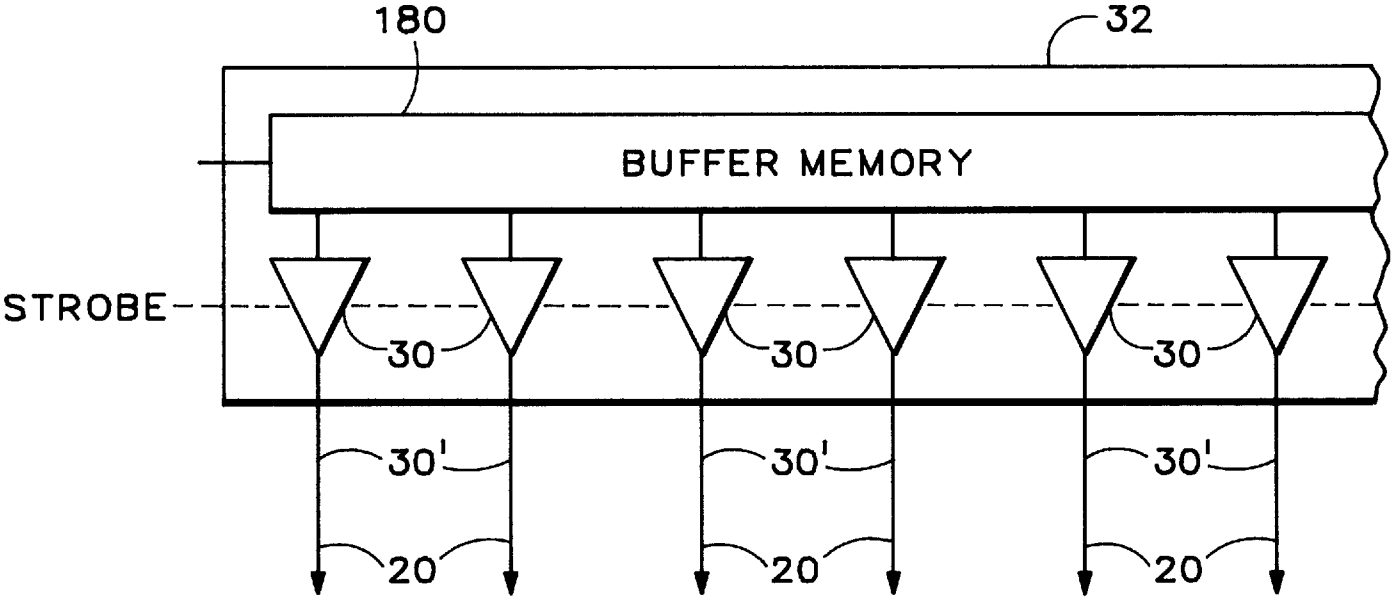
FIG. 5 is a simplified circuit diagram of a data driver employed in the display panel of FIG. 1.

FIG. 5 is a simplified circuit diagram of data driver 32 employed in display system 10. Data driver 32 samples the data signal and stores it in a buffer memory or line store 180. Although the data signal can be in analog or digital form, data driver 32 is described with reference to an analog data signal for purposes of simplicity.

Accordingly, buffer memory 180 can be of the charge-coupled device (CCD) type or the sample-and-hold type, and devices 30 are unity gain amplifiers switchable between inverting and noninverting operation to provide the inverted and noninverted data signals, respectively. Devices 30 permit the parallel transfer of analog voltages to column electrodes 20.

It will be obvious to those having skill in the art that many changes may be made in the above-described details of the preferred embodiment of the present invention without departing from the underlying principles thereof. The scope of the present invention should, therefore, be determined only by the following claims.

I claim:

1. In a liquid crystal flat panel display having an addressing structure for addressing and delivering data signals of plural magnitudes to plural display elements arranged in an array, the plural magnitudes corresponding to plural display light levels and the display elements having incidental electrical couplings that carry incidental data components among the display elements, the improvement comprising:

a frequency-sensitive liquid crystal material responsive to data signals of plural magnitudes delivered to the display elements and having a relatively small dielectric anisotropy for signal frequencies greater than a characteristic threshold frequency; and data drive means for delivering the data signals of plural magnitudes to the display elements so as to selectively address display elements with data signals of frequencies less than the characteristic threshold frequency and to form incidental data components at frequencies greater than the characteristic threshold frequency.

2. The display of claim 1 in which the data drive means delivers the data signals of plural magnitudes and inverted data signals of plural magnitudes to the plural display elements during respective first and second time intervals, the second time intervals preceding the first time intervals, thereby to form the incidental data with components at frequencies greater than the characteristic threshold frequency.

3. The display of claim 1 in which the dielectric anisotropy of the frequency-sensitive liquid crystal material is approximately zero for signal frequencies greater than the characteristic threshold frequency.

4. The display of claim 1 in which each address location includes an ionizable gaseous medium in communication with an electrical reference and the frequency-sensitive liquid crystal material, and ionizing means providing a data strobe signal for selectively effecting ionization of the ionizable gaseous medium to provide an interruptible electrical connection between the electrical reference and the frequency-sensitive liquid crystal material, thereby to address the address location.

5. An electro-optical addressing structure for addressing and delivering data signals of plural magnitudes to plural address locations arranged in an array, the plural magnitudes corresponding to plural electro-optical activation levels and multiple address locations having incidental electrical couplings that carry incidental data components between the address locations, comprising:

a frequency-sensitive electro-optic material responsive to data signals of plural manitudes delivered to the address locations and having a relatively small dielectric anisotropy for signal frequencies greater than a characteristic threshold frequency; and data drive means for delivering the data signals of plural magnitudes to the plural address locations so as to selectively address display elements with data signals of frequencies less than the characteristic threshold frequency and to form incidental data components at frequencies greater than the characteristic threshold frequency.

6. The addressing structure of claim 5 in which the electro-optic material includes a nematic liquid crystal material.

7. The addressing structure of claim 5 in which the data drive means delivers the data signals of plural magnitudes and inverted data signals of plural magnitudes to the plural address locations during respective first and second time intervals, the second time intervals preceding the first time intervals, thereby to form the incidental data with components at frequencies greater than the characteristic threshold frequency.

8. The addressing structure of claim 7 in which the first and second time intervals are of substantially equal duration.

9. The addressing structure of claim 5 in which the dielectric anisotropy of the frequency-sensitive electro-optic material is approximately zero for signal frequencies greater than the characteristic threshold frequency.

10. The addressing structure of claim 5 in which each address location includes an ionizable gaseous medium in communication with an electrical reference and the frequency sensitive electro-optic material, and ionizing means providing a data strobe signal for selectively effecting ionization of the ionizable gaseous medium to provide an interruptible electrical connection between the electrical reference and the frequency-sensitive electro-optic material, thereby to address the address location.

11. An electro-optical addressing structure for addressing and delivering data signals of plural magnitudes to plural address locations arranged in an array, the plural magnitudes corresponding to plural electro-optical activation levels and multiple address locations having incidental electrical couplings that carry incidental data signals among the address locations, comprising:

an electro-optic material that is substantially nonresponsive to signal frequencies greater than a characteristic threshold frequency; and data drive means for delivering the data signals of plural magnitudes to the plural address locations so as to selectively address display elements with data signals of frequencies less than the characteristic threshold frequency and to form incidental data signals with components of frequencies greater than the characteristic threshold frequency.

12. The addressing structure of claim 11 in which the electro-optic material includes a nematic liquid crystal material.

13. The addressing structure of claim 11 in which the data drive means delivers the data signals of plural magnitudes and inverted data signals of plural magnitudes to the plural address locations during respective first and second time interval, the second time intervals preceding the first time intervals, thereby to form the incidental data signals with components of frequencies greater than the characteristic threshold frequency.

* * * * *